US005345851A

United States Patent [19]

Aalfs

[11] Patent Number: 5,345,851

[45] Date of Patent: Sep. 13, 1994

[54] ARTICULATED FINGERBOARD FOR A STRINGED MUSICAL INSTRUMENT

[75] Inventor: Thomas J. Aalfs, Cornwall, N.Y.

[73] Assignee: Gibson Guitar Corp., Nashville, Tenn.

[21] Appl. No.: 9,453

[22] Filed: Jan. 27, 1993

[51] Int. Cl.[5] ..... G10D 3/00

[52] U.S. Cl. ..... 84/315

[58] Field of Search ..... 84/314 R, 315

[56] References Cited

U.S. PATENT DOCUMENTS

| | | | |
|---|---|---|---|
| D. 26,423 | 12/1896 | Livermore | D17/17 |
| D. 275,686 | 9/1984 | Beasley | 84/314 R X |
| 524,428 | 8/1894 | Waring | 84/314 R |
| 798,869 | 9/1905 | Brandt | 84/314 R |
| 939,486 | 11/1909 | Fish | 84/314 R |
| 967,507 | 8/1910 | Finney | 84/314 R |
| 973,719 | 10/1910 | Consoli | 84/314 R |
| 1,095,900 | 5/1914 | Manby | 84/314 R |
| 1,126,957 | 2/1915 | Consoli | 84/314 R |
| 1,237,872 | 8/1917 | Crow | 84/314 R |
| 1,348,894 | 8/1920 | Rahne | 84/314 R |
| 1,472,943 | 11/1923 | Shaeffer | 84/314 R |
| 1,795,825 | 3/1931 | Bonner | 84/314 R |
| 4,023,460 | 5/1977 | Kuhnke | 84/314 |
| 4,987,816 | 1/1991 | Poor | 84/314 R |
| 5,063,818 | 11/1991 | Salazar | 84/314 R |
| 5,085,115 | 2/1992 | Schlink | 84/310 |

*Primary Examiner*—Michael L. Gellner
*Assistant Examiner*—Patrick J. Stanzione
*Attorney, Agent, or Firm*—Dougherty, Hessin, Beavers & Gilbert

[57] ABSTRACT

A fingerboard is provided for a stringed musical instrument of the type having a nut, a bridge and a plurality of strings supported by the nut and the bridge. The fingerboard has a top surface underlying the strings and has a longitudinal axis generally parallel to the strings. A plurality of raised playing areas are located upon the fingerboard to correspond to chromatic fingering points on the fingerboard. Each raised playing area has a width generally parallel to the longitudinal axis of the fingerboard. The width of each raised playing area is sufficient that a fingertip of a musician playing the instrument may finger one of the strings on the raised playing area with the fingertip selectively defining an end point of vibration of one of the strings at any selected position across the width of the raised playing area.

41 Claims, 2 Drawing Sheets

ARTICULATED FINGERBOARD FOR A STRINGED MUSICAL INSTRUMENT

BACKGROUND OF THE INVENTION

1. Field Of The Invention

The present invention relates generally to stringed musical instruments, and more particularly, but not by way of limitation, to instruments of the violin family which are played with a bow.

2. Description Of The Prior Art

Many stringed instruments of the violin family have a smooth, non-fretted fingerboard. Such instruments include the violin, cello, viola, the upright or double bass, and some electric basses. These instruments are usually played with a bow although occasionally they are played by plucking.

One of the inherent difficulties in learning to play a stringed musical instrument having a smooth fretless fingerboard is that it requires great experience to be able to accurately finger the strings to precisely generate the desired notes, since there are no frets on the fingerboard against which to position the fingers.

The prior art of course also includes many fretted stringed instruments such as guitars wherein the strings are held down against the edge of a fret so that the end point of vibration of the string is precisely determined by the position of the edge of the fret across which the string is held. To use a traditional fret on a violin, however, would interfere with the normal manner of playing the violin in that it would not be possible to play vibrato (accomplished by a rapid rolling of the fingertip against the fingerboard as the bow is drawn across the string). Nor would subtle changes in pitch be possible.

The prior art has included a number of proposals for providing finger positioning aids on a violin.

U.S. Pat. No. 4,023,460 to Kuhnke discloses an intonation aid for a violin wherein a molded plastic member fits over the fingerboard and provides conventional raised frets against which the string can be fretted. A similar structure is disclosed in U.S. Pat. No. 524,428 to Waring. Other references suggesting conventional frets include U.S. Pat. No. 5,085,115 to Schlink; U.S. Pat. No. 1,795,825 to Bonner; U.S. Pat. No. 798,869 to Brandt; U.S. Pat. No. 1,237,872 to Crow; and U.S. Pat. No. D-26,423 to Livermore.

Another group of prior references suggests the use of raised finger positioning aids which are located adjacent but not below the strings, so the strings are not actually fretted against the raised surfaces. These include U.S. Pat. No. 967,507 to Finney; U.S. Pat. No. 1,348,894 to Rahne; and U.S. Pat. No. 939,486 to Fish.

Another group of references provides a visual and/or tactile finger position indicator through the use of strips which are either flush with the top surface of the fingerboard or are recessed from the top surface of the fingerboard. These include U.S. Pat. No. 1,126,957 to Consoli; U.S. Pat. No. 973,719 to Consoli; and U.S. Pat. No. 1,095,900 to Manby.

Another proposal found in U.S. Pat. No. 1,472,943 to Shaeffer includes a plurality of transverse grooves defined in the fingerboard within which grooves the fingers are pressed so as to hold the string against the fret defined between adjacent grooves.

Thus it is seen that there is a need for a finger positioning aid for a fretless stringed musical instrument such as a violin which will allow ready visual and tactile finger positioning without interfering with the traditional playing mode of the violin. Also, there is a need for such a system which can be readily attached to either existing or newly constructed instruments in an aesthetically pleasing fashion without structurally damaging the existing fingerboard.

SUMMARY OF THE INVENTION

An improved fingerboard is provided for a stringed musical instrument having a nut, a bridge and a plurality of strings supported by the nut and the bridge. The fingerboard has a top surface underlying the strings and has a longitudinal axis generally parallel to the strings.

A plurality of raised playing areas are located upon the fingerboard to correspond to proper fingering points on the fingerboard. Each raised playing area has a width generally parallel to the longitudinal axis of the fingerboard. Each raised playing area has a height above the top surface of the fingerboard. The width of each raised playing area is sufficient that a fingertip of a musician playing the instrument may finger one of the strings on top of the raised playing area with the fingertip selectively defining an end point of vibration of said one string at any selected position across the width of the raised playing area.

The improved fingerboard may be incorporated in newly manufactured instruments or may be added through the use of a kit to retrofit existing instruments.

The musician fingers the string on top of the raised playing area in a manner substantially identical to that in which a string is conventionally fingered on a smooth violin fingerboard. Thus, finger movement is possible across the width of the strip allowing the musician to impart vibrato and pitch variation in a conventional manner.

The raised playing areas extend only a very short distance above the normal top surface of the fingerboard so that they can be provided on the fingerboard in a very aesthetically pleasing manner.

Additionally, the height of the raised playing areas prevents the string from striking the top surface of the fingerboard adjacent the point where it is fingered, thus reducing string vibration damping as compared to conventional fingerboards. Less dampening also allows for lower string height which can make an instrument easier to play.

This fingerboard provides advantages for both the professional musician who desires clearer tone and more distinct articulation and the beginner who desires tactile and visual references.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

In FIG. 4, all twenty-four of the raised playing areas for a typical violin are illustrated.

DETAILED DESCRIPTION OF THE PREFERRED EMBODIMENTS

Figure 1:
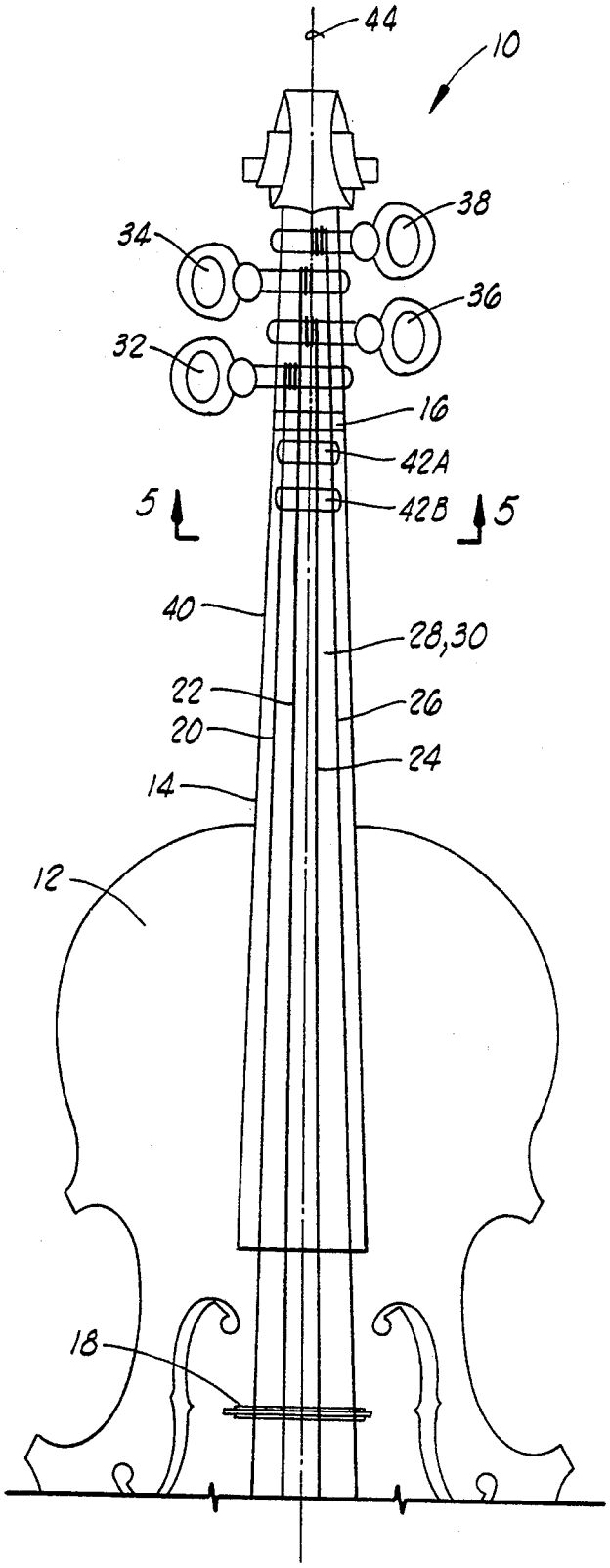
FIG. 1 is a top plan view of a violin. Only a few of the finger positioning strips are actually illustrated in FIG. 1.
Figure 2:
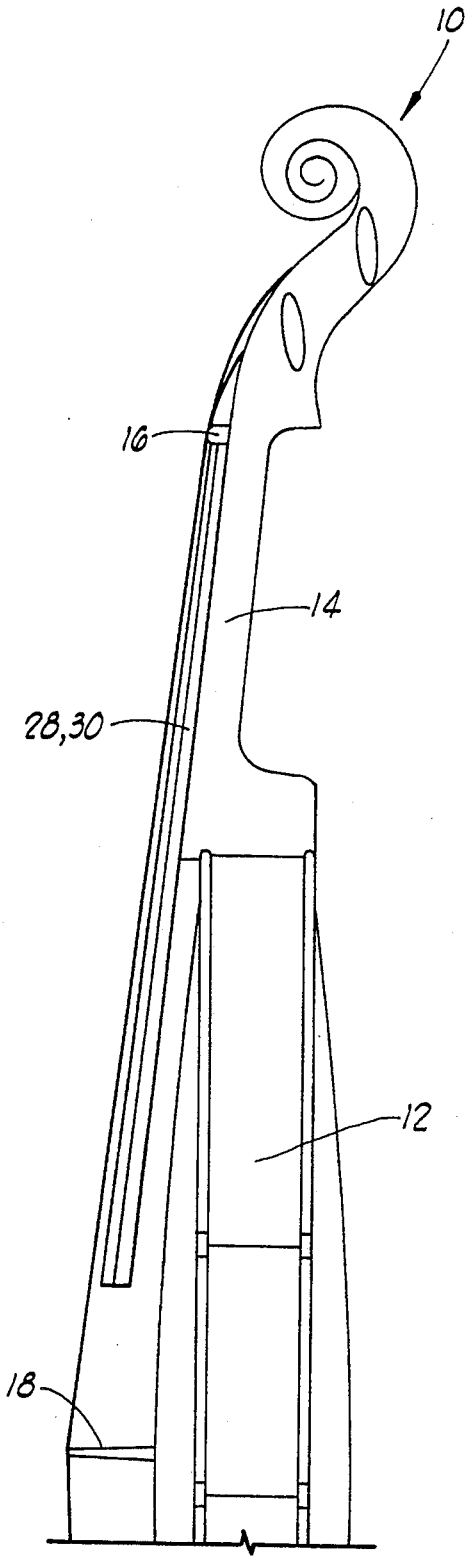
FIG. 2 is a side elevation view of the violin of FIG. 1. Due to the small scale of FIG. 2, no attempt has been shown to illustrate the height of the finger positioning strips.

Referring now to the drawings, and particularly to FIGS. 1 and 2, a stringed musical instrument, namely a violin, is thereshown and generally designated by the numeral 10. It will be understood that the present invention may be applied to many different stringed musical instruments, particularly those of the violin family such as the violin, the viola, the cello, the upright or double bass, and the electric bass. The present invention is primarily intended for application on stringed musical instruments of the type which commonly have a smooth, non-fretted fingerboard. These types of instruments typically are instruments played with a bow, but they may also be plucked. The present invention could, however, also be used on stringed instruments of the type that normally use conventional frets, e.g., guitars, banjos or mandolins.

The instrument 10 has a body 12 and a neck 14. A nut 16 is located on the neck 14, and a bridge 18 is located on the body 12. A plurality of strings, e.g., four strings 20, 22, 24 and 26, are supported by the nut 16 and bridge 18 above a top surface 28 of a fingerboard 30 supported from the neck 14. Tuning keys 32, 34, 36 and 38 adjust the tension in strings 20, 22, 24 and 26, respectively.

String 20 is the string of lowest tone or the G string. String 22 is a D string. String 24 is an A string. String 26 is the string of highest tone or the E string.

Figure 4:
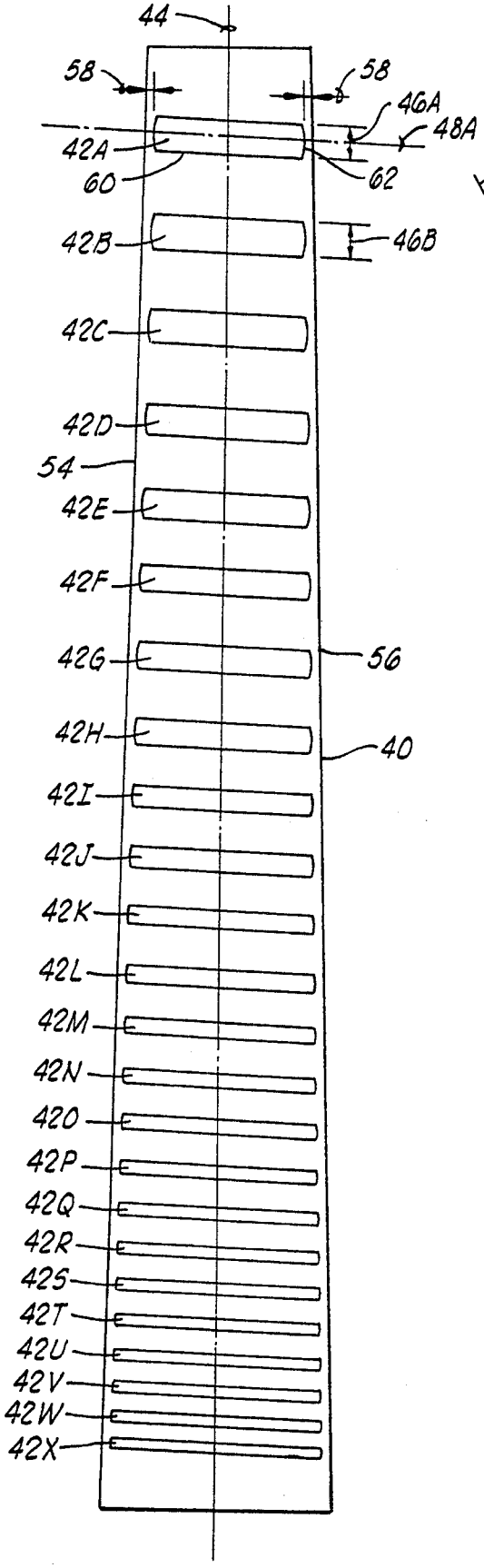
FIG. 4 is an enlarged top plan view of the fingerboard of the instrument of FIG. 1.

As best seen in FIG. 4, on top surface 28 of fingerboard 30, there are contained twenty-four raised playing areas 42A–42X. The fingerboard 30 has an outer boundary 40 in the top plan view of FIG. 1. Each of the raised playing areas located upon fingerboard 30 corresponds to a proper fingering point for one of the twenty-four notes of a two-octave chromatic scale.

The instrument 10 and fingerboard 30 have a longitudinal axis generally indicated at 44. The longitudinal axis can be described as being generally parallel to the length of the strings 20–24, but it will be understood that the strings 20–24 may in fact be at a slight acute angle to the longitudinal axis 44.

Each of the raised playing areas 42 has a width 46 generally parallel to the longitudinal axis 44 and to the strings. The widths of the playing areas 42A–42X are designated as 46A–46X, respectively.

Figure 3:
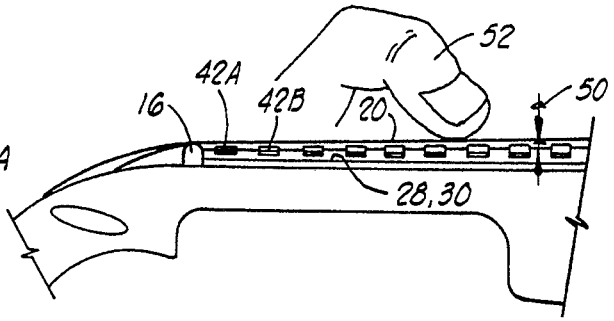
FIG. 3 is a schematic, enlarged side elevation view somewhat similar to FIG. 2 illustrating the manner in which a musician fingers a string on the top of one of the raised playing areas.

Each of the raised playing areas such as 42A can be described as having a transverse center line 48 transverse to the longitudinal axis 44, such as the transverse center line designated as 48A. As best seen in FIG. 3, each of the playing areas 42 has a height 50 above top surface 28 at the transverse center line 48 immediately below the strips. It is noted that the height 50 is a relatively shallow height preferably about 0.020 on a violin. On a violin, the height 50 should be within the range of from about 0.010 inch to 0.030 inch, and more preferably in the range of from about 0.015 to about 0.025 inch. On a different instrument (i.e., the bass), these numbers change so as to be appropriate to size of instrument, strings, etc.

Also, it may be necessary to raise the nut 16 with a shim of thickness approximately equal to the height 50, to prevent the strings from vibrating against the raised playing areas.

The width 46 of each of the raised playing areas 42 is sufficient that a fingertip 52 of a musician playing the instrument 10 may finger one of the strings on the raised playing area with the fingertip selectively defining an end point of vibration of said one of the strings at any selected position across the width 46 of the particular raised playing area 42. The fingertip 52 pushes the string against the top of playing area 42; this is contrasted to conventional prior art frets where the string is pressed against a definite edge of a fret.

The use of raised areas having a substantial width with the player playing on top of the raised areas allows the player to have plus or minus pitch variation from each musical half step and therefore also allows vibrato while providing a tactile and visual guide for audibly distinct half steps.

It is noted that the width 46 of each of the raised playing areas is very much greater than the height 50 of the raised playing area.

The height 50 of each of the raised playing areas is sufficient to prevent, or at least substantially reduce the occurrence of, the strings striking the top surface 28 adjacent the playing area 42 against which the string is fingered. Thus, when the string is vibrated, string vibration dampening is reduced as compared to a conventional prior art smooth fingerboard without raised playing areas. In a conventional smooth fingerboard, when the string is fingered against any particular point on the fingerboard, it will tend to vibrate against the fingerboard adjacent the point of fingering, thus somewhat dampening the vibration of the string. As noted, this string vibration dampening phenomena is substantially eliminated through the use of the present invention thus providing a clearer tone and more distinct articulation.

Figure 5:
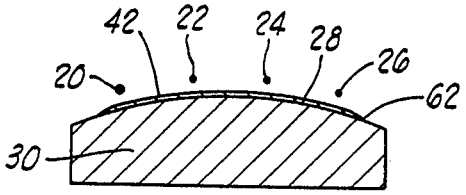
FIG. 5 is a cross-section, elevation view through the neck of the violin taken along line 5—5 of FIG. 1. It illustrates the manner in which the edges of the playing areas preferably are feathered. It also illustrates the height of the playing areas above the top surface of the fingerboard.

Each of the raised playing areas 42 is a substantially planar playing area which is oriented substantially parallel to the top surface 28 of the fingerboard. It will be understood that this top surface is not defined in a flat plane, but somewhat of a curved plane which is substantially parallel to the slightly curved top surface 28. The curvature of the top surface 28 of fingerboard 30 is best seen in FIG. 5.

As is apparent in FIG. 4, the width 46 of successive ones of the playing areas 42 varies. Preferably these widths are proportionally related so that moving from the nut 16 toward the bridge 18, the width of each raised playing area is greater than the width of the next successive raised playing area. This proportional relationship preferably is a logarithmic relationship, and more preferably is a relationship based upon the twelfth root of two wherein the width of each raised playing area 42 is equal to approximately 1.0594631 times the width of the next successive raised playing area.

The logarithmic relationship of the width of adjacent raised areas keeps a constant proportional relationship between each raised area and each one-half step distance, which is also a logarithmic relationship.

Additionally, the width 46 of each raised playing area 42 is preferably equal to a constant proportion of a distance between theoretical adjacent half-step points. Preferably, said constant proportion is one-third of the distance between a point and the last preceding point on a violin. This one-third proportion is for a violin. The analogous proportion could vary considerably on other instruments, such as the bass, where it could be much less.

Preferably, the width 46 of each of the raised playing areas 42 is substantially the same below each of the strings 20–24. Also, the center line 48 of each of the raised playing areas 42 preferably is oriented at an acute angle to the longitudinal axis of the fingerboard, so that the center line 48 of each raised playing area below the G string is closer to the nut 16 than is the center line 48 of the raised playing area below the E string.

The angular orientation of the playing areas results from a difference in mass, tension, elasticity, height of strings and fingering technique.

This angle differs slightly for different ones of the strips. As shown below in the table setting forth an example of the desired placement of the playing areas on the violin, it is preferable that the angle decreases when moving from the nut to the bridge.

As best seen in FIG. 4, it is preferred that the raised playing areas 42 not extend entirely to the first and second longitudinal edges 54 and 56 of the fingerboard 30. Preferably a space 58 of approximately one to two millimeters is left between the raised playing areas and the edges 54 and 56 on a violin.

Each of the raised playing areas 42 has a peripheral edge 60 extending therearound. Preferably at least a portion 62 thereof adjacent the E string and running nearest the second edge 56 of fingerboard 30 is a feathered edge which smoothly joins the top surface 28 of fingerboard 30. Depending upon the manner of construction of the raised playing areas 42, it may be possible to provide a feathered edge around the entire periphery 60 of each raised playing area 42.

This feathered edge portion 62 is best illustrated in the cross-sectional view of FIG. 5.

The following table sets forth an example of the widths and positions of the raised playing areas 42A–42X for one exemplary embodiment of the present invention. This example is for a conventional violin having standard 330 centimeter long violin string length from nut 16 to bridge 18. The dimensions given below are based upon having the area of raised strips 42 equal to 33⅓ percent of the area of the top surface 28 of fingerboard 30. The first column identifies the raised playing area. The second column defines the distance from the nut 16 to the center line 48 of the strip underlying the G string. The third column defines the distance from the nut 16 to the center line 48 under the E string, thus defining in combination with the second column the angle at which the center line 48 crosses the longitudinal axis 44. The fourth column defines the width of the raised playing area.

| Raised Playing Area | Dist. To Center Line At G String (mm) | Dist. To Center Line At E String (mm) | Width (mm) |
|---|---|---|---|
| 42A | 17.7 | 19.2 | 6.2 |
| 42B | 35.2 | 36.7 | 5.8 |
| 42C | 51.6 | 53.1 | 5.5 |
| 42D | 67.2 | 68.7 | 5.2 |
| 42E | 81.9 | 83.3 | 4.9 |
| 42F | 95.8 | 97.2 | 4.6 |

-continued

| Raised Playing Area | Dist. To Center Line At G String (mm) | Dist. To Center Line At E String (mm) | Width (mm) |
|---|---|---|---|
| 42G | 108.8 | 110.2 | 4.4 |
| 42H | 121.1 | 122.5 | 4.1 |
| 42I | 132.8 | 134.2 | 3.9 |
| 42J | 143.8 | 145.1 | 3.7 |
| 42K | 154.2 | 155.5 | 3.5 |
| 42L | 164.0 | 165.2 | 3.3 |
| 42M | 173.3 | 174.5 | 3.1 |
| 42N | 182.0 | 183.1 | 2.9 |
| 42O | 190.3 | 191.4 | 2.7 |
| 42P | 198.0 | 199.0 | 2.6 |
| 42Q | 205.3 | 206.3 | 2.5 |
| 42R | 212.0 | 213.0 | 2.3 |
| 42S | 218.4 | 219.4 | 2.2 |
| 42T | 224.4 | 225.4 | 2.1 |
| 42U | 230.0 | 231.0 | 1.9 |
| 42V | 235.2 | 236.2 | 1.8 |
| 42W | 240.0 | 241.0 | 1.7 |
| 42X | 244.5 | 245.5 | 1.6 |

The positions indicated for the playing areas in the table are desired positions. It will be understood that due to the fact that the musician fingers on top of the raised playing areas, as contrasted to fingering against distinct fretting edges, as in the prior art, there is an inherent forgiveness for misplacement of the raised playing areas since there is not a distinct fingering point but instead there is a zone across which a desired fingering point can be found. This also allows a player to compensate for such variables as string materials and construction.

The raised playing areas 42 may be formed on the fingerboard 30 in many different ways.

The raised playing areas 42 can be integrally formed with the fingerboard 30 either by molding the fingerboard 30 to include the raised playing areas 42, or by taking a fingerboard 30 having a smooth surface and machining away portions of the fingerboard so as to leave the raised playing areas.

When the raised playing areas are integrally formed on the fingerboard in either of the manners described above, the peripheral edge 60 of each raised playing area 42 can be formed in any desired manner, and can incorporate the most preferred feathered peripheral edge as previously noted.

The present invention can also be provided by means of raised playing areas which are defined on separate strips of material which are individually attached to the fingerboard 30. This manner of construction can be used either on new instruments or in a kit form for retrofitting the finger positioning aids of the present invention onto existing instruments.

Preferably such a kit will include a plurality of raised finger positioning strips each of which will have one of the raised playing areas 42 defined thereon.

Figure 6:
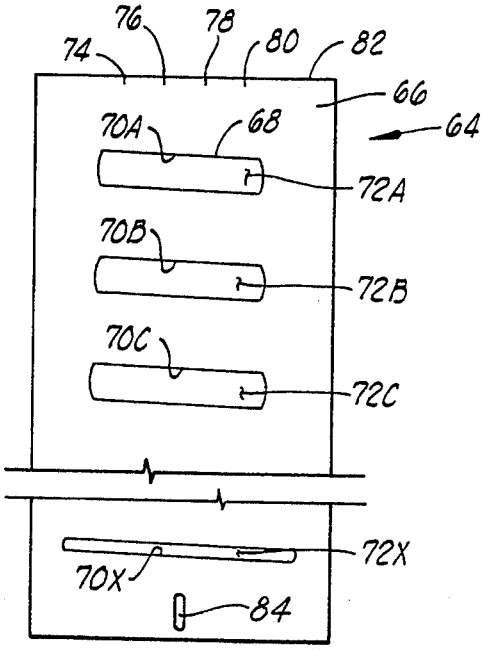
FIG. 6 is a plan view of a template with integral strips which provides a kit for retrofitting the raised playing areas onto an existing violin.

FIG. 6 discloses one form of a kit 64. The kit 64 includes a sheet 66 of the material from which the strips are to be formed. Sheet 66 may be referred to as a single solid sheet 66. Preferably internal portions of the sheet 66 have been cut such as with a die to define perimeters identified as 68. These perimeters define openings 70 within the solid sheet 66. Those portions of material 72 defined within the cut perimeters 68 define a plurality of raised finger positioning strips 72A–72X which correspond to the raised playing areas 42A–42X. Sheet 66 should be precurved to complement the curvature of top surface 28 seen in FIG. 5.

The sheet 66 has a self-adhering material on the back side thereof covered by a peel-off backing. The adhesive provides an attachment means for separately attaching each of the finger positioning strips 72 to the fingerboard 30.

Each of the openings 70A–70X can be generally described as a placement means 70A–70X for locating the strips 72A–72X in proper relative locations on the fingerboard 30 so that each strip 72 lies generally transverse to the strings and underlies the strings.

The sheet 66 has four positioning points 74, 76, 78 and 80 defined on one end thereof which are to be lined up with the notches in the nut 16 corresponding to the position of strings 20–26. At the end nearest the bridge a slot 84 is provided for visual centering on the fingerboard.

The openings 70 can also be referred to as strip location indicators 70 or as indicia 70 corresponding to the proper relative location of the strips 72 on the fingerboard 30.

The sheet 66 having the cut perimeters 68 defined therein can be described as a template 66 including a plurality of openings 70 defined therein. The strips 72 can be described as being received in the opening 70.

To install the finger positioning strips 72 onto a fingerboard 30 of a violin using the kit shown in FIG. 6, the adhesive backing on the back of the strips 72 is uncovered and the sheet 66 is positioned against the fingerboard 30 with the positioning points 74–80 lined up with the notches in nut 16 and with the outer edge 82 of sheet 66 abutting the nut 16. The strips 72A–72X are pressed against the top surface 28 of fingerboard 30 and the remaining template portion of sheet 66 is peeled away thus leaving only the strips 72 in place upon the top surface 28 of fingerboard 30.

It will be apparent that when using the embodiment shown in FIG. 6 it will not be possible to provide a feathered edge around the entire perimeter of each strip unless that feathered edge is formed by sanding or the like after the strip is installed, or unless the cutting process somewhat rounds or feathers the edge. It is possible, however, to provide a tapering thickness to the strips by making the sheet 66 of varying thickness across its width; preferably providing a thinner portion in the area 62 where it is desired to have a feathered edge adjacent the E string.

Another form of kit can be provided by making the template portion of sheet 66 separate from the strips 72. Thus, the template sheet could be made from a different material than the strips 72, such as for example a simple paper template.

When the template sheet is not integrally formed with the strips 72, the template sheet will be positioned upon the fingerboard 30 in a manner like that previously described and then the individual strips 72A–72X will be placed in the openings 70A–70X and pressed down upon the top surface 28 of fingerboard 30. The individual strips 72A–72X will have an adhesive backing on them, but the template sheet need not have an adhesive backing for this particular embodiment. The strips 70 should be molded or formed with a curvature to match surface 28 seen in FIG. 5.

With this second embodiment wherein the strips are individually formed separate from the template sheet, it will be possible to preform the strips having a somewhat feathered edge.

One common form of construction of the fingerboard 30 is to construct it from a phenolic or ebony material. Thus, the strips 72 can also be constructed from a thin sheet 66 of this same phenolic material. Preferably, the strips 72 are of the same color as the material from which the fingerboard 30 is made, typically a black material.

Also, it may be desirable to make the edges of strips 42 closest to the bridge a lighter color so they are more visible to the musician while still being invisible from most angles.

This provides a very aesthetically pleasing appearance wherein the relatively shallow raised strips 72 are hardly visible when the instrument is viewed from any distance.

The raised playing areas of the present invention also can be provided by means of a complete replacement fingerboard having the raised playing areas defined thereon, so that the fingerboard 30 is mounted upon the neck of the violin in place of the previously existing fingerboard.

Yet another manner of providing the raised playing areas of the present invention is to provide a sheet of permanent backing that has the raised playing areas defined thereon and the entire sheet including the raised playing areas is semi-permanently attached to the existing fingerboard by adhesive material or otherwise.

An advantage of the present invention is that it is much easier to play "in tune" than is a conventional smooth fingerboard with no indicia for appropriate fingering points. Also, it provides a clearer sound because there is less string vibration dampening due to the fact that the raised playing areas hold the string above the remainder of the top surface 28 immediately adjacent the fingering point. Additionally, more distinct articulation of notes is provided, especially noticeable on fast passages.

Thus it is seen that the apparatus of the present invention readily achieves the ends and advantages mentioned as well as those inherent therein. While certain preferred embodiments of the invention have been illustrated and described for purposes of the present disclosure, numerous changes may be made by those skilled in the art which changes are encompassed within the scope and spirit of the present invention as defined by the appended claims.

What is claimed is:

1. A fingerboard for a stringed musical instrument having a nut, a bridge, and a plurality of strings supported by said nut and said bridge, comprising:

said fingerboard having a planar top surface underlying said strings and having a longitudinal axis; and a plurality of raised playing areas located upon said fingerboard to correspond to proper fingering points on said fingerboard, each raised playing area having a width generally parallel to said longitudinal axis of said fingerboard, and each raised playing area having a height above said top surface of said fingerboard, and said width of each raised playing area being sufficient that a fingertip of a musician playing said instrument may finger one of said strings on said raised playing area with the fingertip selectively defining an end point of vibration of said one of said strings at any selected position across said width of said raised playing area.

2. The fingerboard of claim 1, wherein:

said width of each raised playing area is very much greater than said height of each raised playing area.

3. The fingerboard of claim 2, wherein:
said height of each of said raised playing areas is sufficient to prevent said string from striking said top surface of said fingerboard adjacent said raised playing area when said string is vibrated, so that string vibration dampening is reduced as compared to a smooth fingerboard without raised playing areas.

4. The fingerboard of claim 3, wherein:
each of said raised playing areas has a transverse center line transverse to said longitudinal axis, and said height of each of said raised playing areas is at least about 0.010 inch at said transverse center line thereof immediately below each of said strings.

5. The fingerboard of claim 1, wherein:
each of said raised playing areas is oriented substantially parallel to said top surface of said fingerboard.

6. The fingerboard of claim 1, further comprising:
said widths of successive ones of said plurality of raised playing areas being proportionally related so that moving from said nut of said instrument toward said bridge of said instrument, said width of each raised playing area is greater than said width of the next successive raised playing area.

7. The fingerboard of claim 6, wherein:
said proportional relationship of said widths of said raised playing areas is a logarithmic relationship.

8. The fingerboard of claim 7, wherein:
said width of each raised playing area is equal to approximately 1.0594631 times said width of the next successive raised playing area.

9. The fingerboard of claim 6, wherein:
said width of each of said raised playing areas is equal to a constant proportion of a distance between theoretical adjacent one-half step points.

10. The fingerboard of claim 9, wherein:
said constant proportion is approximately one-third of the distance to the last preceding theoretical one-half step point.

11. The fingerboard of claim 1, wherein:
for each one of said raised playing areas, said width of said one playing area is substantially the same below each of said strings of said instrument, said raised playing areas each being oriented at an acute angle to a line perpendicular to said longitudinal axis of said fingerboard so that a portion of each of said raised playing areas below one of said strings having a lowest tone is closer to said nut than is a portion of said raised playing area below another one of said strings having a highest tone.

12. The fingerboard of claim 11, wherein:
said acute angle decreases for each successive raised playing area moving from said nut toward said bridge.

13. The fingerboard of claim 1, wherein:
said raised playing areas are integrally formed on said fingerboard.

14. The fingerboard of claim 1, wherein:
said raised playing areas are defined on separate strips of material which are individually attached to said fingerboard.

15. The fingerboard of claim 1, wherein:
each of said raised playing areas has a peripheral edge and at least a portion of said peripheral edge adjacent one of said strings having a highest tone is a feathered edge smoothly joining said top surface of said fingerboard.

16. The fingerboard of claim 1, said instrument being a violin, wherein:
each of said raised playing areas has a transverse center line transverse to said longitudinal axis, and said height of each of said raised playing areas is in a range of from 0.010 inch to 0.030 inch at said transverse center line thereof immediately below each of said strings.

17. The fingerboard of claim 16, wherein:
said height of each of said raised playing areas is in a range of from 0.015 inch to 0.025 inch.

18. The fingerboard of claim 1, wherein:
an edge of each of said raised playing areas rising vertically from said fingerboard and closest to a musician's eyes is of a different color than a remainder of said raised playing areas so as to be more visible to a musician while still being unnoticeable from most viewing angles.

19. A kit for adding finger positioning aids to a fingerboard of a stringed musical instrument having strings overlying said fingerboard, comprising:
a plurality of raised finger positioning strips;
attachment means for separately attaching each of said finger positioning strips to said fingerboard; and
placement means for locating said strips in proper relative locations on said fingerboard so that each strip lies generally transverse said strings and underlies said strings.

20. The kit of claim 19, wherein:
said placement means includes a strip location indicator having a plurality of indicia thereon corresponding to said proper relative locations of said strips on said fingerboard.

21. The kit of claim 20, wherein:
said strip location indicator is a template and said plurality of indicia includes a plurality of openings defined in said template, said strips being of such size and shape that said strips can be received in said openings when said template is placed over said fingerboard to thereby locate said strips on said fingerboard.

22. The kit of claim 21, wherein:
said strips and said template are formed from a single solid sheet by cutting said sheet to define perimeters of said openings of said template, so that portions of said sheet within said perimeters define said strips.

23. The kit of claim 22, wherein:
said strips and said template sheet are intact so that said plurality of strips may all be placed simultaneously upon said fingerboard and said template may then be removed leaving said strips in their proper relative locations upon said fingerboard.

24. The kit of claim 21, wherein:
said template and said strips are separate from each other prior to installation of said strips on said fingerboard.

25. The kit of claim 21, wherein:
said template and said strips are formed from different materials.

26. The kit of claim 19, wherein:
each of said raised finger positioning strips has a top surface defining a raised playing area, and each raised playing area has a width generally parallel to said strings and a height above said fingerboard, and said width of each raised playing area is sufficient that a fingertip of a musician playing said instrument may finger one of said strings on said raised playing area with the fingertip selectively defining an end point of vibration of one of said strings at any selected position across said width of said raised playing area.

27. The kit of claim 26, wherein:

said width of each raised playing area is very much greater than said height of each raised playing area.

28. The kit of claim 27, wherein:

said height of each of said raised playing areas is sufficient to substantially reduce said string striking a top surface of said fingerboard adjacent said raised playing area when said string is vibrated, so that string vibration dampening is reduced as compared to a smooth fingerboard without raised playing areas.

29. The kit of claim 26, wherein:

each of said raised playing areas has a transverse center line transverse to said strings, and said height of each of said raised playing areas is at least about 0.010 inch at said transverse center line thereof immediately below each of said strings.

30. The kit of claim 26, wherein:

each of said raised playing areas is oriented substantially parallel to a top surface of said fingerboard.

31. The kit of claim 26, wherein:

said widths of said raised playing areas of said successive ones of said strings being proportionally related so that moving from one of said strips corresponding to a lowest note toward one of said strips corresponding to a highest note, said width of each raised playing area is greater than said width of the next successive raised playing area.

32. The kit of claim 31, wherein:

said proportional relationship of said widths of said raised playing areas is a logarithmic relationship.

33. The kit of claim 32, wherein:

said width of each raised playing area is equal to approximately 1.0594631 times said width of the next successive raised playing area.

34. The kit of claim 31, wherein:

said width of each of said raised playing areas is equal to a constant proportion of a distance between theoretical adjacent one-half step points.

35. The kit of claim 34, wherein:

said constant proportion is approximately one-third of the distance to the last preceding theoretical one-half step point.

36. The kit of claim 26, said instrument including a nut and a bridge supporting said strings, wherein:

for each one of said raised playing areas, said width of said one playing area is substantially the same below each of said strings of said instrument, said raised playing areas each being oriented at an acute angle to a line perpendicular to said strings of said fingerboard so that a portion of each of said raised playing areas below one of said strings having a lowest tone is closer to said nut than is a portion of said raised playing area below another one of said strings having a highest tone.

37. The kit of claim 36, wherein:

said acute angle decreases for each successive playing area moving from said nut toward said bridge.

38. The kit of claim 19, wherein:

each of said strips has a peripheral edge and at least a portion of said peripheral edge adjacent one of said strings having a highest tone is a feathered edge.

39. The kit of claim 19, wherein:

the entire peripheral edge of each of said strips is a feathered edge.

40. The kit of claim 19, said instrument being a violin, wherein:

each of said raised finger positioning strips has a transverse center line transverse to said strings, and has a thickness at said transverse center line immediately below each of said strings in a range of from 0.010 inch to 0.030 inch.

41. The kit of claim 40, wherein:

said thickness is in a range of from 0.015 inch to 0.025 inch.

* * * * *